US007112356B2

(12) United States Patent
Nomula et al.

(10) Patent No.: US 7,112,356 B2
(45) **Date of Patent: *Sep. 26, 2006**

(54) COMPOSITE CONTAINER WITH RFID DEVICE AND HIGH-BARRIER LINER

(75) Inventors: Srinivas Nomula, Hartsville, SC (US); Thomas J. Setty, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 241 days.

This patent is subject to a terminal disclaimer.

(21) Appl. No.: 10/842,751

(22) Filed: May 11, 2004

(65) Prior Publication Data

US 2005/0255261 A1 Nov. 17, 2005

(51) Int. Cl.
*B32B 1/08* (2006.01)

(52) U.S. Cl. ..... 428/34.2; 428/34.1; 428/35.4; 428/35.7; 428/35.8; 428/35.9; 428/36.6; 428/36.9; 428/36.91

(58) Field of Classification Search ..... 428/35.7, 428/34.1, 34.2, 35.4, 35.8, 35.9, 36.6, 36.9, 428/36.91

See application file for complete search history.

(56) References Cited

U.S. PATENT DOCUMENTS 4,322,003 A 3/1982 Long
5,415,910 A 5/1995 Knauf
5,622,308 A 4/1997 Ito et al.
5,731,093 A 3/1998 Chang et al.
6,218,004 B1 4/2001 Shaw et al.
6,231,939 B1 5/2001 Shaw et al.
2003/0215587 A1 11/2003 Fatica et al.
2005/0255262 A1* 11/2005 Nomula et al. ..... 428/34.2

* cited by examiner

*Primary Examiner*—Nasser Ahmad
(74) *Attorney, Agent, or Firm*—Alston & Bird LLP

(57) ABSTRACT

A high-barrier liner for a composite container that is compatible with the use of RFID devices in the container includes a paper layer having an outer surface for attachment to an inner paperboard surface of a body wall of the container, and a metallized film attached to the inner surface of the paper layer, the metallized film comprising a polymer film substrate having a vapor-deposited layer of metal applied to one surface of the substrate. The liner also includes a heat seal layer disposed on an opposite side of the metallized film from the paper layer and forming an innermost surface of the liner. The metallized film can include a metallization-promoting material coated onto the substrate prior to metallization to improve the uniformity and continuity of the metal layer. The metal layer of the metallized film can have a protective coating applied over it.

21 Claims, 1 Drawing Sheet

COMPOSITE CONTAINER WITH RFID DEVICE AND HIGH-BARRIER LINER

BACKGROUND OF THE INVENTION

The present invention relates to composite containers, and more particularly relates to high-barrier liners for composite containers that incorporate an RFID device.

Conventional composite containers having high-barrier liners have employed foil-based liners. Foil is laminated to a paper or film layer on one side, and a sealant film or layer is laminated to or extrusion-coated onto the other side of the foil. However, radio-frequency identification (RFID) devices cannot be used with composite containers having foil-based liners because the metal foil interferes with the RFID device.

It is increasingly of interest to use RFID devices for the tracking of items through manufacturing, in inventory, in shipment, and the like. Electronic article surveillance (EAS) using RFID devices also can be employed for anti-theft purposes. It would be desirable to incorporate an RFID device in a composite container. Accordingly, non-foil liners composed entirely of polymer materials have been contemplated. However, heretofore polymer-only liners have not been able to achieve the high barrier performance that some types of products require.

BRIEF SUMMARY OF THE INVENTION

The present invention addresses the above needs and achieves other advantages, by providing a high-barrier liner for a composite container that is compatible with the use of RFID devices in the container. The high-barrier liner includes a paper layer having an outer surface for attachment to an inner paperboard surface of a body wall of a composite container and having an opposite inner surface, and a metallized film attached to the inner surface of the paper layer, the metallized film comprising a polymer film substrate having a vapor-deposited layer of metal applied to one surface of the substrate. The liner also includes a sealant layer disposed on an opposite side of the metallized film from the paper layer and forming an innermost surface of the liner, the sealant layer comprising a heat seal material.

In one embodiment of the invention, the metallized film includes a metallization-promoting material coated onto the substrate prior to metallization to improve the uniformity and continuity of the metal layer, thereby enhancing the barrier performance. The metallization-promoting material can comprise an acrylate, polyvinyl alcohol, ethylene vinyl alcohol, polyester copolymer (e.g., PET copolymer), or the like. Alternatively or additionally, the surface of the substrate can be plasma-treated prior to metallization to enhance the barrier performance.

In further embodiments of the invention, the metal layer of the metallized film can have a protective coating applied over it. The protective coating can comprise a lacquer (e.g., nitrocellulose, acrylic, etc.) or a vacuum acrylate coating.

Further enhancement of the barrier performance is provided in other embodiments by including multiple metal layers and protective coating layers. For instance, the metallized film can have a first metal layer applied to the substrate and then covered by a first protective coating, a second metal layer applied over the first protective coating, and a second protective coating applied over the second metal layer.

Barrier performance can also be enhanced by the inclusion of an additional barrier web in the liner. The additional barrier web can comprise a metallized film, an aluminum oxide-coated film, an SiOx-coated film, or a highly oriented film.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
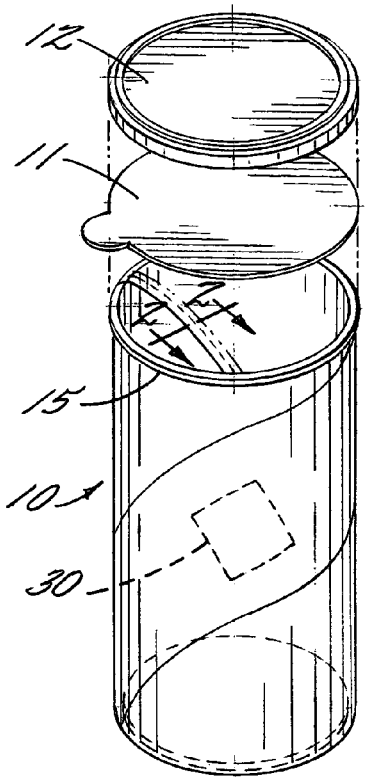
FIG. 1 is a perspective view of a composite container in accordance with one embodiment of the invention.
Figure 2:
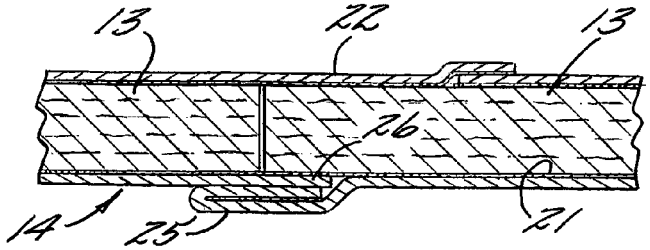
FIG. 2 is a cross-sectional view through the body wall of the container along line 2—2 in FIG. 1.

With reference to FIGS. 1 and 2, there is shown a composite container 10 having a non-foil-based liner in accordance with one embodiment of the present invention. Although illustrated as having a circular cross-section, the tubular container 10 may have any cross-sectional shape that can be formed by wrapping the composite materials around an appropriately shaped mandrel. For example, the tube can be formed in a rectangular shape with rounded corners by convolutely wrapping the materials around a suitably shaped mandrel. The embodiment illustrated in FIG. 1 is particularly advantageous for packaging potato crisps or chips and includes a flexible membrane lid 11 and a reusable plastic end cap 12 over the membrane lid. Various other end closures may be used, however, depending upon the type of product that is to be packaged. For example, where dough is to be packaged, the end caps are typically constructed of metal and are crimp-sealed onto the ends of the container.

The tubular container 10 includes a wall having one or more body plies 13 (FIG. 2) preferably formed of paperboard and a liner ply 14 adhered to the inner surface of the body ply or plies 13. The upper end of the tubular container 10 is rolled over so as to form a bead 15 or flange and the membrane lid 11 is hermetically sealed to the top of the bead. The end cap 12 is then snapped over the bead 15 and may be reused after the membrane lid 11 has been removed. A metal closure (not illustrated) can be secured to the opposite end of the container 10. Alternative closure systems can be used at the container ends. For instance, the top closure can employ a metal ring in conjunction with a membrane lid sealed to the ring. Surprisingly, it has been found that the ring does not interfere with an RFID device in the container.

The seams where the various plies are joined together are illustrated in FIG. 2. In some types of containers such as self-opening containers (e.g., for refrigerated dough), a single body ply is used and the edges of the ply are first skived and then joined together during the tube-forming process with an adhesive to create a strong seam. In other types of containers, a single or multiple body plies may be used and the edges of the ply or plies are not skived and form a butt joint as shown in FIG. 2. In any event, the liner ply 14 is adhered to the inner surface of the body ply or plies 13 with a wet adhesive 21 and the overlapping edges of the liner ply are sealed together to ensure that the container 10 is completely sealed. A label ply 22 is preferably adhered to the outer surface of the body ply 13, and can have various graphics and/or indicia printed thereon regarding the product within the container.

The liner ply 14 includes a fold seal formed by overlapping a folded first edge portion 25 of the liner with an opposite second edge portion 26 of the liner and sealing the overlapping edge portions together, as further described below.

The container 10 can incorporate an RFID device 30. The RFID device can be attached to an outer surface of the label 22, disposed between the label and the body ply or plies 13, disposed between two body plies, or located elsewhere in the container. The location of the RFID device is not of particular importance to the present invention.

RFID works on an inductive principle. In a passive RFID system, a reader generates a magnetic field at a predetermined frequency. When an RFID device, which usually can be categorized as being either read-only or read/write, enters the magnetic field, a small electric current forms in the device's resonant circuit, which includes a coiled antenna and a capacitor. This circuit provides power to the RFID device, which then modulates the magnetic field in order to transmit information that is pre-programmed on the device back to the reader at a predetermined frequency, such as 125 kHz (low frequency) or 13.56 MHz (high frequency). The reader then receives, demodulates, and decodes the signal transmission, and then sends the data onto a host computer associated with the system for further processing.

An active RFID system operates in much the same way, but in an active system the RFID device includes its own battery, allowing the device to transmit data and information at the touch of a button. For example, a remote control garage door opener typically uses an active RFID device that transmits a predetermined code to the receiver in order to raise and lower the garage door at the user's discretion.

Another technology that is related to RFID is known as Bistatix, which operates much the same way as RFID devices except that the coiled antenna and capacitor of the RFID device are replaced by a printed, carbon-based material. As a result, a Bistatix device is extremely flat and relatively flexible, although currently these types of devices are limited to a frequency range of about 125 KHz. In addition, the read range of a Bistatix device is dependent on size, so for long read ranges a very large device may be required. In the present application, the term RFID is used to encompass all of the above-described technologies.

One of the considerations that must be taken into account because of the incorporation of the RFID device 30 is that the presence of metal in the vicinity of the device can interfere with the proper operation of the device. Therefore, the inclusion of the RFID device rules out the possibility of using a metal foil-based liner 14. Accordingly, the present invention provides alternative liner structures capable of being used with RFID devices and also capable of achieving the levels of high-barrier performance that certain types of products require. For instance, some products require a liner having a water vapor transmission rate (WVTR) of less than 0.1 g/100 $in^2$/day, or even less than 0.01 g/100 $in^2$/day, and/or an oxygen transmission rate (OTR) of less than 0.1 cc/100 $in^2$/day, or even less than 0.01 cc/100 $in^2$/day. Such high levels of barrier performance generally have not been attainable with liners formed entirely of polymer materials.

Figure 3:
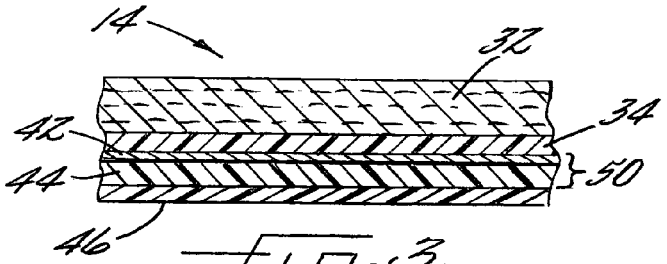
FIG. 3 is a schematic cross-sectional view of a liner in accordance with one embodiment of the invention.

A liner structure in accordance with a first embodiment of the invention is schematically depicted in FIG. 3. The liner 14 is free of any metal foil layers. The liner includes a backing layer 32 of paper such as inextensible kraft or the like. The paper layer 32 is adhesive-laminated or extrusion-laminated to a metallized film 50; thus, layer 34 represents a layer of adhesive in the case of adhesive-lamination, or an extruded polymer layer in the case of extrusion-lamination. The liner also includes a sealant layer 46 disposed on the opposite surface of the metallized film 50 from the paper layer 32. The sealant layer 46 comprises a heat seal material. Various heat seal materials may be used, including but not limited to ionomer resins (e.g., SURLYN®, an ethylene acid copolymer with acid groups partially neutralized with zinc or sodium ions), high-density polyethylene (HDPE), low-density polyethylene (LDPE), coextruded film structures (e.g., ionomer/HDPE coex, LDPE/HDPE coex, etc.). The particular sealant material is not of importance to the present invention.

The metallized film 50 comprises the primary barrier layer of the liner. The metallized film in this embodiment comprises a film core layer 44 and a metal layer 42. The metal layer 42 is vacuum- or vapor-deposited on the surface of the film core layer 44, which serves as the substrate for the metal layer. Various metals can be used, but aluminum is most commonly employed. Processes for metallizing film are well known and are not further described herein. The film core layer 44 can comprise various polymers, including but not limited to polyethylene, polypropylene, polyester such as polyethylene terephthalate, nylon, and the like.

The liner structure of FIG. 3 is suitable for use in the container 10 having the RFID device 30 because the amount of metal in the metal layer 42 is quite small. Indeed, the thickness of the metal layer of a metallized film is so small that typically it is not measured in physical dimensions but rather in terms of the surface-resistivity of the resulting metallized film (e.g., in ohms per square). Nevertheless, it has been estimated that the metal layer typically has a thickness on the order of a few hundred Angstroms. If an average thickness of 300 Angstroms is assumed, it can be calculated that for a container liner having a total surface area of about 0.1 $m^2$, the total mass is about 0.0081 g. Thus, it is apparent that the total amount of metal that would be in the vicinity of an RFID device is exceedingly small, and hence does not interfere with the device.

Figure 4:
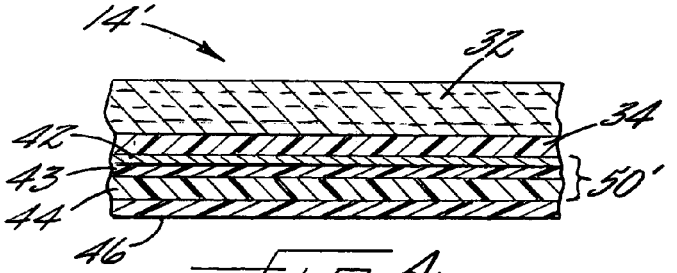
FIG. 4 is a cross-sectional view of a liner in accordance with another embodiment of the invention.

The liner structure of FIG. 3 can achieve reasonably good barrier performance, but may not be sufficient for some types of products requiring extremely high-barrier performance. FIG. 4 shows an alternative liner structure that offers enhanced barrier potential. The liner 14' is generally similar to that of FIG. 3, including a paper layer 32 adhesive- or extrusion-laminated by an intermediate adhesive or extrusion layer 34 to a metallized film 50' and having a sealant layer 46. However, the metallized film 50' includes a coating 43 on the film core layer 44 for promoting the uniform and continuous metallization of the film core layer. The metallization-promoting coating 43 can comprise an acrylate, polyvinyl alcohol, ethylene vinyl alcohol, polyester copolymer (e.g., PET copolymer), or the like. Alternatively, the surface of the film core layer can be plasma-treated prior to metallization to enhance the uniformity and continuity of the metal layer. The coating 43 or plasma treatment thus enhance the barrier performance of the metallized film, since discontinuities in the metal layer have deleterious effects on barrier performance.

Figure 5:
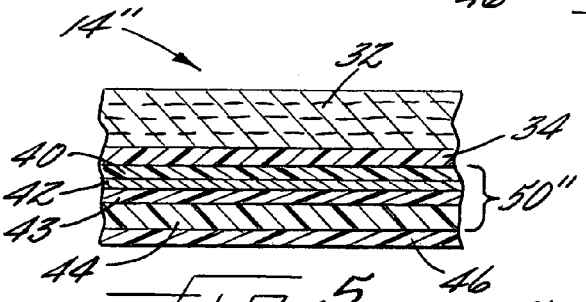
FIG. 5 is a cross-sectional view of a liner in accordance with a further embodiment of the invention.

With respect to discontinuities in the metal layer, although some of them can result from the metallization process itself, in other cases they can be introduced subsequent to metallization such as by inadvertently scratching the metal layer during handling of the film. To reduce the incidence of such breaches in the metal layer, it is advantageous for the metallized film to include a protective coating over the metal layer. FIG. 5 shows a liner 14" having such a metallized film. The liner 14" includes a paper layer 32 adhesive- or extrusion-laminated by an intermediate adhesive or extrusion layer 34 to a metallized film 50" and having a sealant layer 46. The metallized film 50" includes a coating 43 on the film core layer 44 for promoting the uniform and continuous metallization of the film core layer, and also includes a protective coating 40 applied over the metal layer 42 of the metallized film. The protective coating can comprise various materials including but not limited to a lacquer (e.g., nitrocellulose, acrylic, etc.) or a vacuum acrylate coating.

Figure 6:
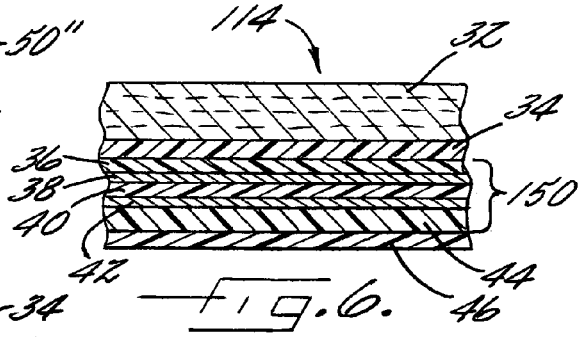
FIG. 6 is a cross-sectional view of a liner in accordance with still another embodiment of the invention.

Still further enhancement of the barrier performance can be achieved in accordance with further embodiments of the invention. For example, FIG. 6 illustrates a liner 114 comprising a paper layer 32 adhesive- or extrusion-laminated by an intermediate adhesive or extrusion layer 34 to a metallized film 150 and having a sealant layer 46. The metallized film 150 comprises a film core layer 44, a first metal layer 42 applied to the surface of the film core layer, a first protective coating 40 applied over the first metal layer 42, a second metal layer 38 applied over the first protective coating 40, and a second protective coating 36 applied over the second metal layer 38.

Figure 7:
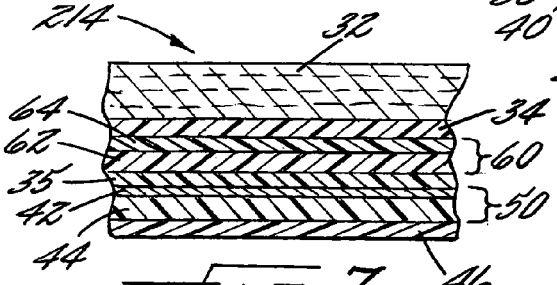
FIG. 7 is a cross-sectional view of a liner in accordance with yet another embodiment of the invention.

Liners in accordance with the invention can also include an additional barrier layer when extremely high barrier performance is needed. An example is shown in FIG. 7. The liner 214 of FIG. 7 comprises a paper layer 32 adhesive- or extrusion-laminated by an intermediate adhesive or extrusion layer 34 to a barrier web 60, which in turn is adhesive- or extrusion-laminated by an intermediate adhesive or extrusion layer 35 to a metallized film 50. A sealant layer 46 is disposed on the opposite side of the metallized film from the barrier web 60. The metallized film 50 comprises a film core layer 44 and a metal layer 42 as previously described. The barrier web 60 includes a film layer 62 and a barrier coating 64. The film layer 62 can comprise various polymers such as polyethylene, polypropylene, polyester such as polyethylene terephthalate, nylon, and the like. The film layer 62 can be highly oriented. The barrier coating 64 can comprise various materials such as aluminum oxide, SiOx (i.e., silicon dioxide ($SiO_2$) or $Si_2O_3$), and the like. Alternatively, the barrier coating 64 can comprise a vapor-deposited metal layer such that the barrier web 60 comprises a metallized film.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A composite container, comprising:

a tubular body wall comprising paperboard material, the body wall defining an inner paperboard surface facing toward an interior of the container;

a liner adhered to the inner paperboard surface of the body wall, the liner comprising:

a paper layer having an outer surface facing the inner paperboard surface of the body wall and having an inner surface facing toward the interior of the container;

a metallized film attached to the inner surface of the paper layer, the metallized film comprising a polymer film substrate having a vapor-deposited layer of metal applied to one surface of the substrate; and a sealant layer disposed on an opposite side of the metallized film from the paper layer and forming an innermost surface of the liner, the sealant layer comprising heat seal material; and an RFID device incorporated in the container.

2. The composite container of claim 1, wherein the polymer film substrate of the metallized film comprises a film core having opposite first and second surfaces and a coating of a metallization-promoting material applied to the first surface of the film core, the metal layer of the metallized film being applied to the metallization-promoting material.

3. The composite container of claim 2, wherein the metallization-promoting material comprises acrylate.

4. The composite container of claim 2, wherein the metallization-promoting material comprises polyvinyl alcohol.

5. The composite container of claim 2, wherein the metallization-promoting material comprises ethylene vinyl alcohol.

6. The composite container of claim 2, wherein the metallized film includes a protective coating over the metal layer.

7. The composite container of claim 1, wherein the metallized film includes a protective coating over the metal layer.

8. The composite container of claim 7, wherein the protective coating comprises a lacquer.

9. The composite container of claim 7, wherein the protective coating comprises a vacuum acrylate coating.

10. The composite container of claim 1, wherein the polymer film substrate of the metallized film comprises polyethylene terephthalate.

11. The composite container of claim 1, wherein the polymer film substrate of the metallized film comprises polyethylene.

12. The composite container of claim 1, wherein the polymer film substrate of the metallized film comprises polypropylene.

13. The composite container of claim 1, wherein the polymer film substrate of the metallized film comprises nylon.

14. The composite container of claim 1, wherein the metallized film comprises a first protective coating applied over the metal layer, a second metal layer applied over the first protective coating, and a second protective coating applied over the second metal layer.

15. The composite container of claim 1, wherein the liner further comprises a second metallized film disposed between the paper layer and the sealant layer.

16. The composite container of claim 1, wherein the liner further comprises an aluminum oxide-coated film disposed between the paper layer and the sealant layer.

17. The composite container of claim 1, wherein the liner further comprises an SiOx-coated film disposed between the paper layer and the sealant layer.

18. The composite container of claim 1, wherein the liner further comprises an oriented polymer film disposed between the paper layer and the sealant layer.

19. The composite container of claim 18, wherein the oriented polymer film comprises a polyester.

20. The composite container of claim 18, wherein the oriented polymer film comprises polypropylene.

21. The composite container of claim 1, wherein the one surface of the polymer film substrate of the metallized film is plasma-treated prior to metallization.

* * * * *